US008523318B2

(12) United States Patent
Beng Keong et al.

(10) Patent No.: US 8,523,318 B2
(45) Date of Patent: Sep. 3, 2013

(54) SUPPORT FOR CARRIAGE GUIDE IN PRINTER

(75) Inventors: Ang Beng Keong, Singapore (SG); Venkatesh Mysore Nagaraja Rao, Singapore (SG); Jacob J. Ruden, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 167 days.

(21) Appl. No.: 13/238,559

(22) Filed: Sep. 21, 2011

(65) Prior Publication Data

US 2013/0070019 A1 Mar. 21, 2013

(51) Int. Cl.
*B41J 11/22* (2006.01)
*B41J 23/00* (2006.01)

(52) U.S. Cl.
USPC ..... 347/37; 400/352

(58) Field of Classification Search
USPC ..... 400/352, 354; 347/37
See application file for complete search history.

(56) References Cited

U.S. PATENT DOCUMENTS

| | | | | |
|---|---|---|---|---|
| 5,195,836 | A * | 3/1993 | Longust et al. | 400/354 |
| 5,838,345 | A * | 11/1998 | Kerr et al. | 347/37 |
| 5,871,292 | A * | 2/1999 | Johnson et al. | 347/37 |
| 6,637,958 | B2 * | 10/2003 | Smith | 400/354.3 |
| 6,872,019 | B2 | 3/2005 | Schalk et al. | |
| 7,350,902 | B2 | 4/2008 | Dietl et al. | |
| 2005/0243124 | A1 * | 11/2005 | Miyazaki et al. | 347/37 |
| 2011/0249054 | A1 * | 10/2011 | Wang | 347/20 |

FOREIGN PATENT DOCUMENTS

JP 2003266850 A * 9/2003

* cited by examiner

*Primary Examiner* — Shelby Fidler
(74) *Attorney, Agent, or Firm* — Peyton C. Watkins

(57) ABSTRACT

A carriage printer includes a printhead; a carriage guide disposed along a carriage scan direction, the carriage guide including a first end and a second end opposite the first end; a carriage for transporting the printhead along the carriage scan direction across the print region, the carriage including a bearing surface that is configured to contact the carriage guide as the carriage transports the printhead; a plurality of carriage guide supports each including a support surface, the plurality of carriage guide supports including a first carriage guide support disposed proximate the first end; a second carriage guide support disposed proximate the second end; and a third carriage guide support disposed between the first carriage guide support and the second carriage guide support; a first biasing force applied in a bias direction proximate the first end; and a second biasing force applied in the bias direction proximate the second end.

17 Claims, 13 Drawing Sheets

SUPPORT FOR CARRIAGE GUIDE IN PRINTER

FIELD OF THE INVENTION

The present invention generally relates a carriage printer, and more particularly a support for the carriage guide to reduce vibrations.

BACKGROUND OF THE INVENTION

In a carriage printer, such as an inkjet carriage printer, a printhead is mounted in a carriage that is moved back and forth across the region of printing. To print an image on a sheet of paper or other print medium, the medium is advanced a given nominal distance along a media advance direction and then stopped. While the medium is stopped and supported on a platen, the printhead carriage is moved in a direction that is substantially perpendicular to the media advance direction as marks are controllably made by marking elements on the medium—for example by ejecting drops from an inkjet printhead. After the carriage has printed a swath of the image while traversing the print medium, the medium is advanced, the carriage direction of motion is reversed, and the image is formed swath by swath.

FIG. 1 shows a schematic side view of a conventional carriage printer having a so-called L-shaped paper path. A variety of rollers are used to advance the medium through the printer. In this example, a pick roller 350 moves the first piece or sheet 371 of a stack 370 of paper (also generically called recording medium herein) at media input support 320 from paper load entry direction 301 toward media retention plate 340. The first piece 371 of recording medium is then moved by feed roller 312 and idler roller(s) 323 to advance through the print region 303, and from there to a discharge roller 324 and star wheel(s) 325. Carriage 200 moves a printhead die 251 along a carriage scan direction that is into the plane of FIG. 1 and ink drops 270 are controllably ejected to print an image as the carriage is moved. The motion of carriage 200 is guided by carriage guide 382, which is a round rod, for example, that is disposed along the carriage scan direction. Supporting the first piece 371 of recording medium at print region 303 is a platen 390. In order to facilitate the printing of borderless prints where the image is printed to the edges of the recording medium, platen 390 can have support ribs 394 in between which is disposed an absorbent medium 392 to catch ink drops that are oversprayed beyond the edges of the recording medium. The top surfaces of support ribs 394 are located at substantially a same level, so that they define a plane of the print region 303, i.e. the plane of support of the recording medium in the print region 303.

In order for the ink drops 270 to land accurately at their intended positions on first piece 371 of recording medium, it is important for the carriage 200 to move uniformly along the carriage scan direction. However, it is found that the carriage guide 382 can be undesirably set into vibration, for example along vibration direction 385. Such vibration of the carriage guide 382 can cause nonuniform motion of the carriage 200 and the printhead die 251, so that the ink drops do not land accurately at their intended positions, thereby degrading print quality.

What is needed is a simple, low cost way of reducing vibration of the carriage guide so that the carriage printer can reliably provide high quality printing.

SUMMARY OF THE INVENTION

The present invention is directed to overcoming one or more of the problems set forth above. Briefly summarized, according to one aspect of the invention, the invention resides in a carriage printer comprising a printhead; a print region; a carriage guide disposed along a carriage scan direction, the carriage guide including a first end and a second end opposite the first end; a carriage for transporting the printhead along the carriage scan direction across the print region in reciprocating fashion, the carriage including a bearing surface that is configured to contact the carriage guide as the carriage transports the printhead; a plurality of carriage guide supports each including a support surface, the plurality of carriage guide supports including: a first carriage guide support disposed proximate the first end; a second carriage guide support disposed proximate the second end; and a third carriage guide support disposed between the first carriage guide support and the second carriage guide support; a first biasing force applied in a bias direction proximate the first end; and a second biasing force applied in the bias direction proximate the second end, wherein the first biasing force and the second biasing force urge the carriage guide into contact with the first support surface, the second support surface and the third support surface.

These and other objects, features, and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

Figure 2:
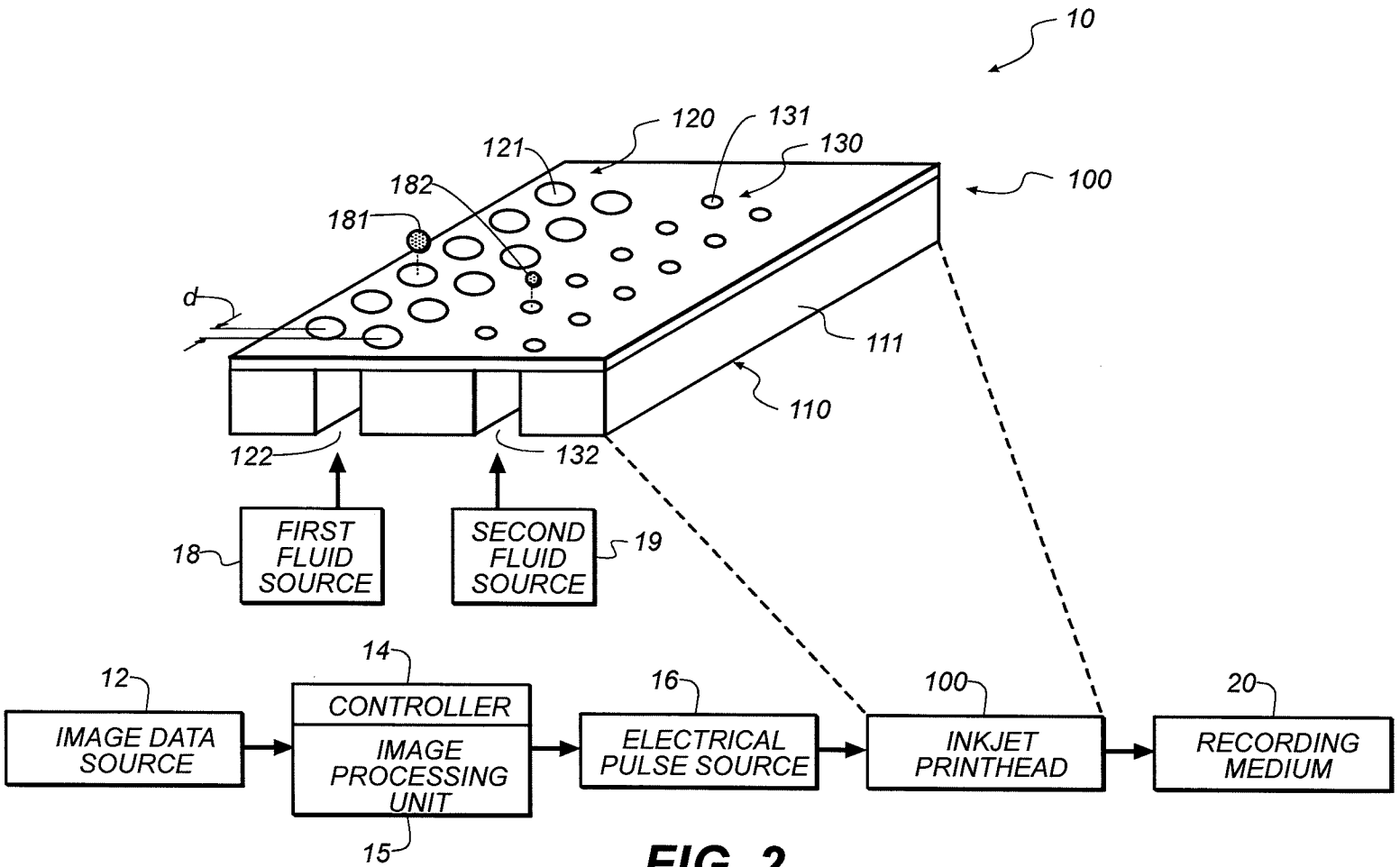
FIG. 2 schematically shows an inkjet printer system.

Referring to FIG. 2, a schematic representation of an inkjet printer system 10 is shown for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

Figure 3:
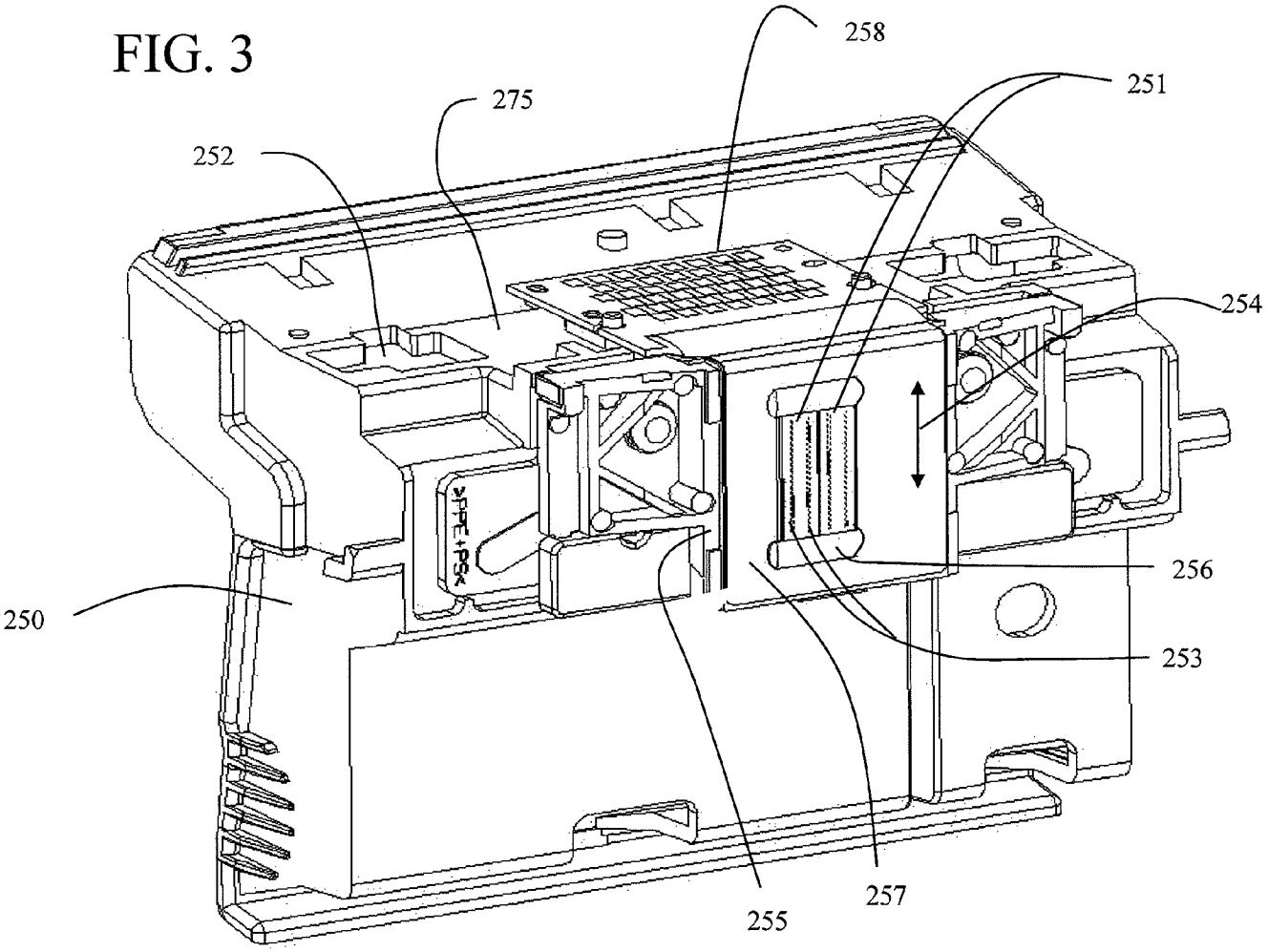
FIG. 3 is a perspective of a printhead.

In the example shown in FIG. 2, there are two nozzle arrays 120 and 130 that are each disposed along a nozzle array direction 254 (see FIG. 3). Nozzles 121 in the first nozzle array 120 have a larger opening area than nozzles 131 in the second nozzle array 130. In this example, each of the two nozzle arrays 120, 130 has two staggered rows of nozzles 121, 131, each row having a nozzle density of 600 per inch. The effective nozzle density then in each array is 1200 per inch (i.e. d=1/1200 inch in FIG. 2). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array 120, 130 is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 2 as openings through printhead die substrate 111. One or more inkjet printhead die 110 will be included in inkjet printhead 100, but for greater clarity only one inkjet printhead die 110 is shown in FIG. 2. The printhead die are arranged on a mounting support member as discussed below relative to FIG. 3. In FIG. 2, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it can be beneficial to have a single fluid source supplying ink to both the first nozzle array 120 and the second nozzle array 130 via ink delivery pathways 122 and 132, respectively. Also, in some embodiments, fewer than two or more than two nozzle arrays can be included on inkjet printhead die 110. In some embodiments, all nozzles on inkjet printhead die 110 are the same size, rather than having multiple sized nozzles on inkjet printhead die 110.

The drop forming mechanisms associated with the nozzles 121, 131 are not shown in FIG. 2. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 2, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20 (also sometimes called paper, print medium or medium herein).

FIG. 3 shows a perspective of a portion of a printhead 250, which is an example of an inkjet printhead 100. Printhead 250 includes two printhead die 251 (similar to inkjet printhead die 110 of FIG. 2) that are affixed to a common mounting support member 255. Each printhead die 251 contains two nozzle arrays 253, so that printhead 250 contains four nozzle arrays 253 altogether. The four nozzle arrays 253 in this example can each be connected to separate ink sources. Each of the four nozzle arrays 253 is disposed along nozzle array direction 254, and the length of each nozzle array along nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 3 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into the carriage 200 (see FIG. 4), connector board 258 is electrically connected to a connector (not shown) on the carriage 200, so that electrical signals can be transmitted to the printhead die 251. (Parts 252 & 259 are on FIG. 3, need to be added to description). (I removed 252 and 259 from FIG. 3.)

Figure 4:
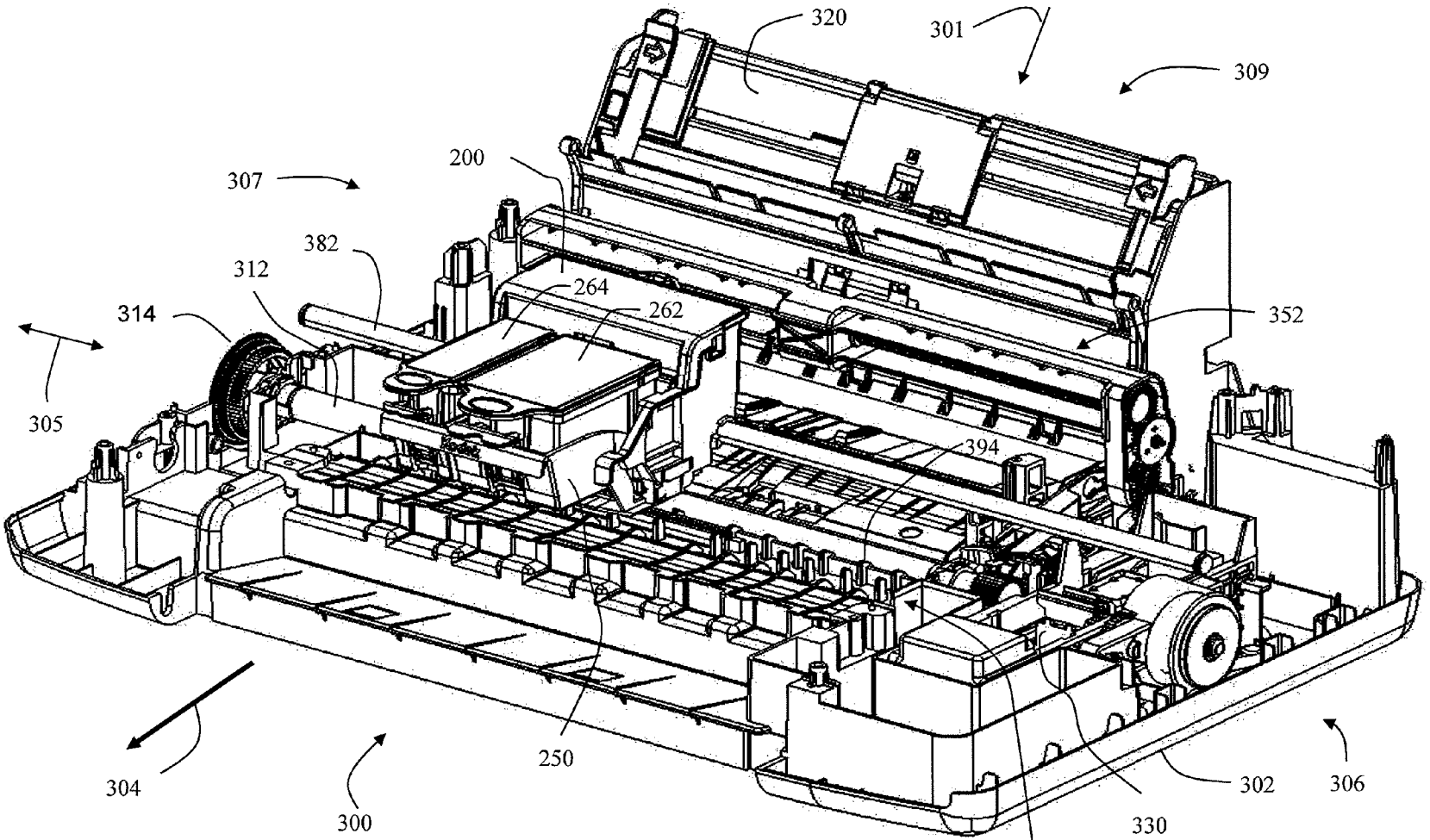
FIG. 4 is a perspective of a carriage printer.

FIG. 4 shows a portion of a desktop carriage printer. Some of the parts of the printer have been hidden in the view shown in FIG. 4 so that other parts can be more clearly seen. Printer chassis 300 includes a horizontal base 302. Carriage 200 is moved back and forth in carriage scan direction 305, between the right side 306 and the left side 307 of printer chassis 300, while drops are ejected from printhead die 251 (not shown in FIG. 4) on printhead 250 that is mounted on and transported by carriage 200. A carriage motor (not shown) moves carriage 200 in reciprocating fashion along carriage guide 382. Carriage guide 382 is a round rod in this embodiment. The support structure for carriage guide 382 is not shown in FIG. 4, but is discussed in detail below with reference to FIGS. 5-13.

Printhead 250 is mounted in carriage 200, and multi-chamber ink supply 262 and single-chamber ink supply 264 are mounted in the printhead 250. The mounting orientation of printhead 250 is rotated relative to the view in FIG. 3, so that the printhead die 251 are located at the bottom side of printhead 250, the droplets of ink being ejected downward in the view of FIG. 4. Multi-chamber ink supply 262, for example, contains three ink sources: e.g. cyan, magenta, and yellow ink; while single-chamber ink supply 264 contains black ink. Toward the right side 306 of the printer chassis 300, in the example of FIG. 4, is the maintenance station 330.

Figure 1:
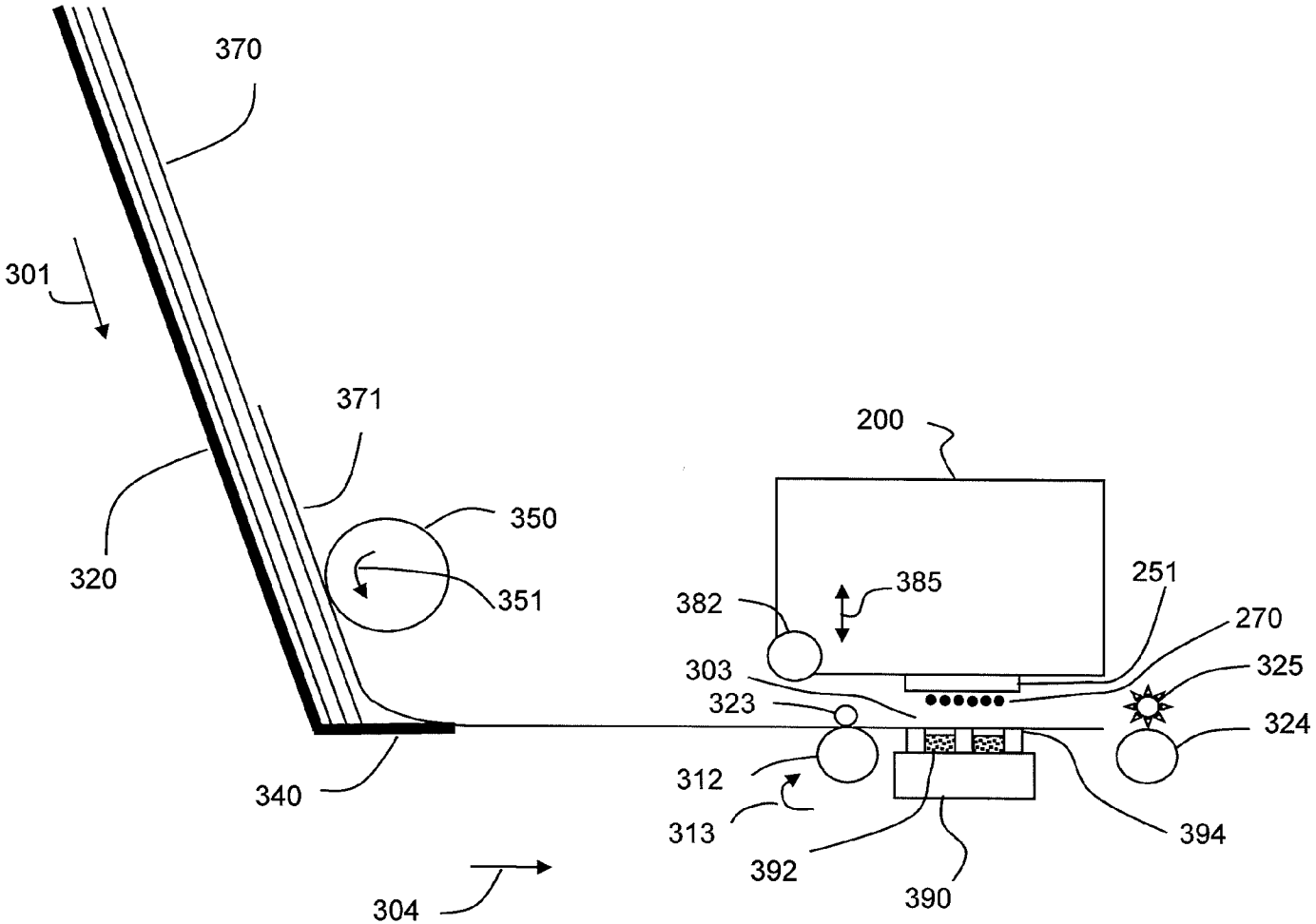
FIG. 1 is a schematic side view of a conventional printer having an L-shaped paper path.

In the L-shaped paper path shown in FIGS. 1 and 4, the recording medium 20 would be loaded along paper load entry direction 301 nearly vertically relative to horizontal base 302 (or relative to media retention plate 340) against media input support 320 at the rear 309 of the printer chassis. Several rollers are used to advance the recording medium through the printer. A pick roller 350 on pick arm assembly 352 is rotated in rotation direction 351 to move the first piece or sheet 371 of a stack 370 of paper or other recording medium in media input support 320 from paper load entry direction 301 to the media advance direction 304. The paper is then moved by feed roller 312 (as it is rotated in forward rotation direction 313) and idler roller(s) 323 to advance toward the print region 303 (disposed along carriage scan direction 305). Feed roller 312 is driven directly by a paper advance motor (not shown) that is connected by belt or gear engagement, for example at drive gear 314. After the image is printed at print region 303, where piece 371 of recording medium is supported by support ribs 394, the piece 371 of recording medium is further advanced to a discharge roller 324 and star wheel(s) 325.

Figure 5:
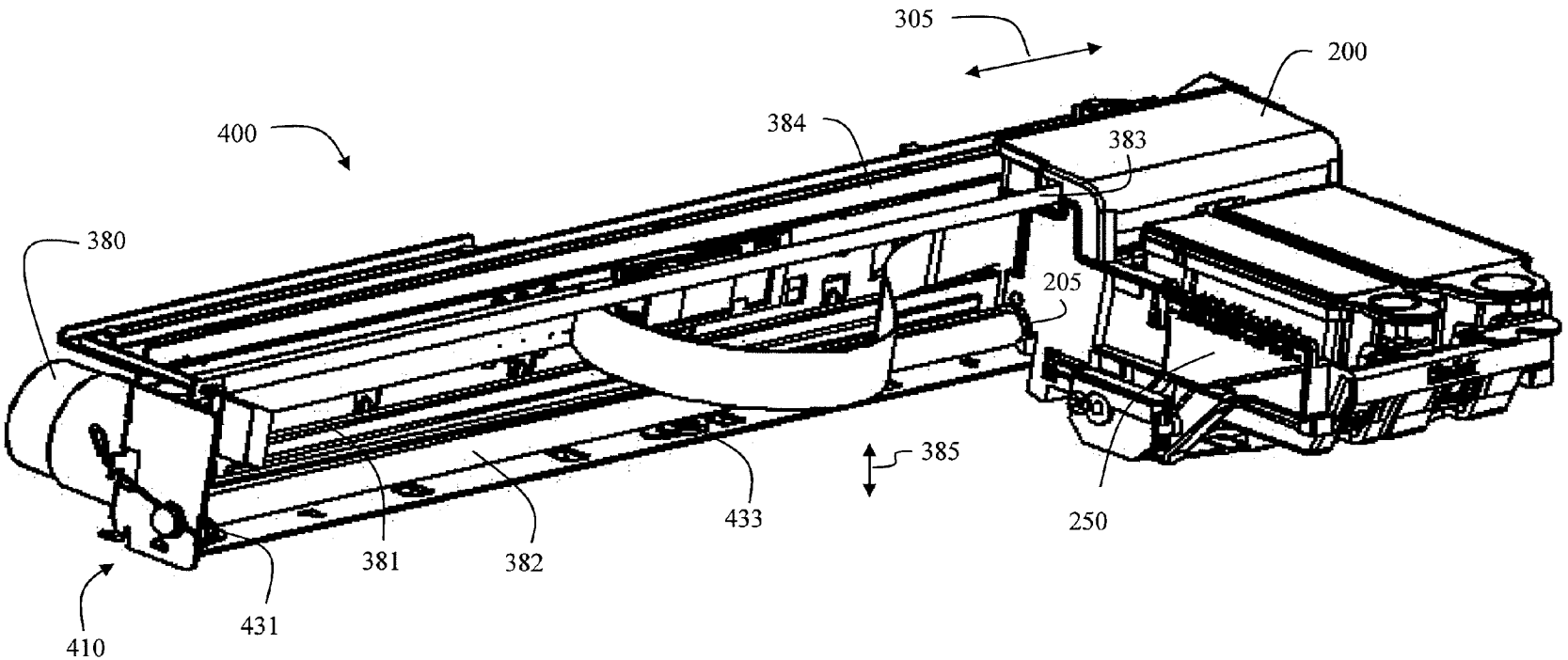
FIG. 5 is a perspective of a carriage guide assembly according to an embodiment of the invention.

FIG. 5 is a perspective of a carriage guide assembly 400 together with carriage 200 according to an embodiment of the invention. Carriage 200 includes one or more bearing surfaces that are configured to contact the carriage guide 382 and anti-rotation guide 384 as the carriage 200 transports the printhead 250. Bearing surfaces can include bushings 205 to glide along carriage guide 382 in carriage scan direction 305. Carriage motor 380 moves belt 381 in order to move carriage 200 along carriage scan direction 305. Position of carriage 200 along carriage scan direction 305 is determined with reference to a linear encoder 383. Carriage guide 382 is held against frame 410 and is supported by carriage guide supports 431, 432 (not shown on FIG. 5) and 433 (see also FIG. 6). Forced contact of carriage guide 382 against carriage guide supports 431, 432 and 433 helps to reduce vibration along vibration direction 385, as is discussed in further detail below.

Figure 6:
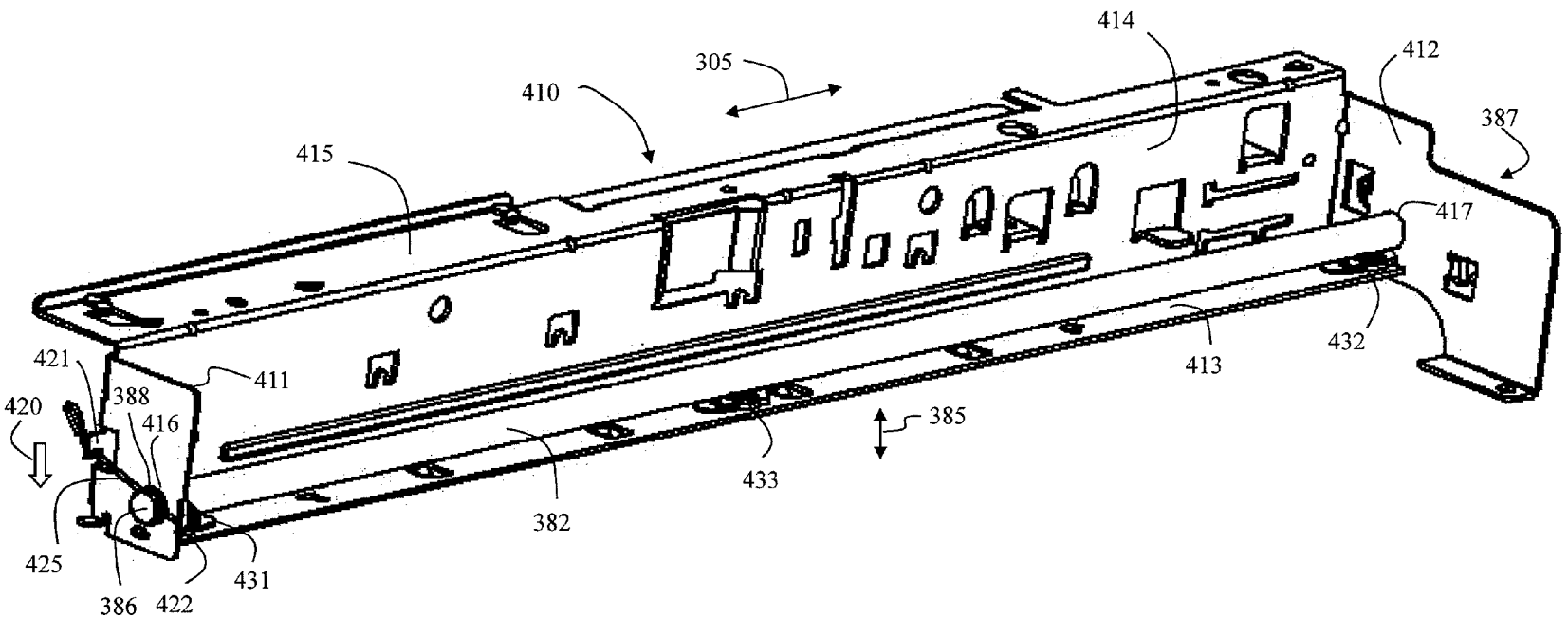
FIG. 6 is a perspective similar to FIG. 5, but with some parts hidden.

FIG. 6 is a perspective similar to FIG. 5, but with some parts hidden so that carriage guide 382, frame 410 and carriage guide supports 431, 432 and 433 can be seen more clearly. Carriage guide 382 includes a first end 386 and a second end 387 opposite first end 386. Frame 410 includes a first wall 411 located near first end 386 of carriage guide 382, a second wall 412 located near second end 387 of carriage guide 382, and a third wall 413 that extends along carriage scan direction 305 between first wall 411 and second wall 413. Frame 410 is typically made of sheet metal and can also include other walls, such as back wall 414 (to which carriage motor 380, not shown, is attached), and top wall 415 (to which anti-rotation guide 384, not shown, is attached). First carriage guide support 431 is positioned near first end 386 of carriage guide 382. Second carriage guide support 432 is positioned near second end 387 of carriage guide 382. Third carriage guide support 433 is positioned between first carriage guide support 431 and second carriage guide support 432. It has been found that if there is no third carriage guide support 431 so that carriage guide 382 is only supported near its ends 386 and 387, it is more susceptible to being set into vibration along vibration direction 385. The fundamental mode of vibration of a carriage guide 382 supported only at its two ends is one in which the amplitude of vibration is largest near its midpoint. By further constraining carriage guide 382 to be in contact with a support surface of third carriage guide support 433, located approximately midway between support surfaces of the first carriage guide support 431 and second carriage guide support 432, the fundamental mode of vibration of carriage guide 382 along vibration direction 385 is substantially eliminated. First carriage guide support 431, second carriage guide support 432 and third carriage guide support 433 are affixed to third wall 413 of frame 410.

Figure 7:
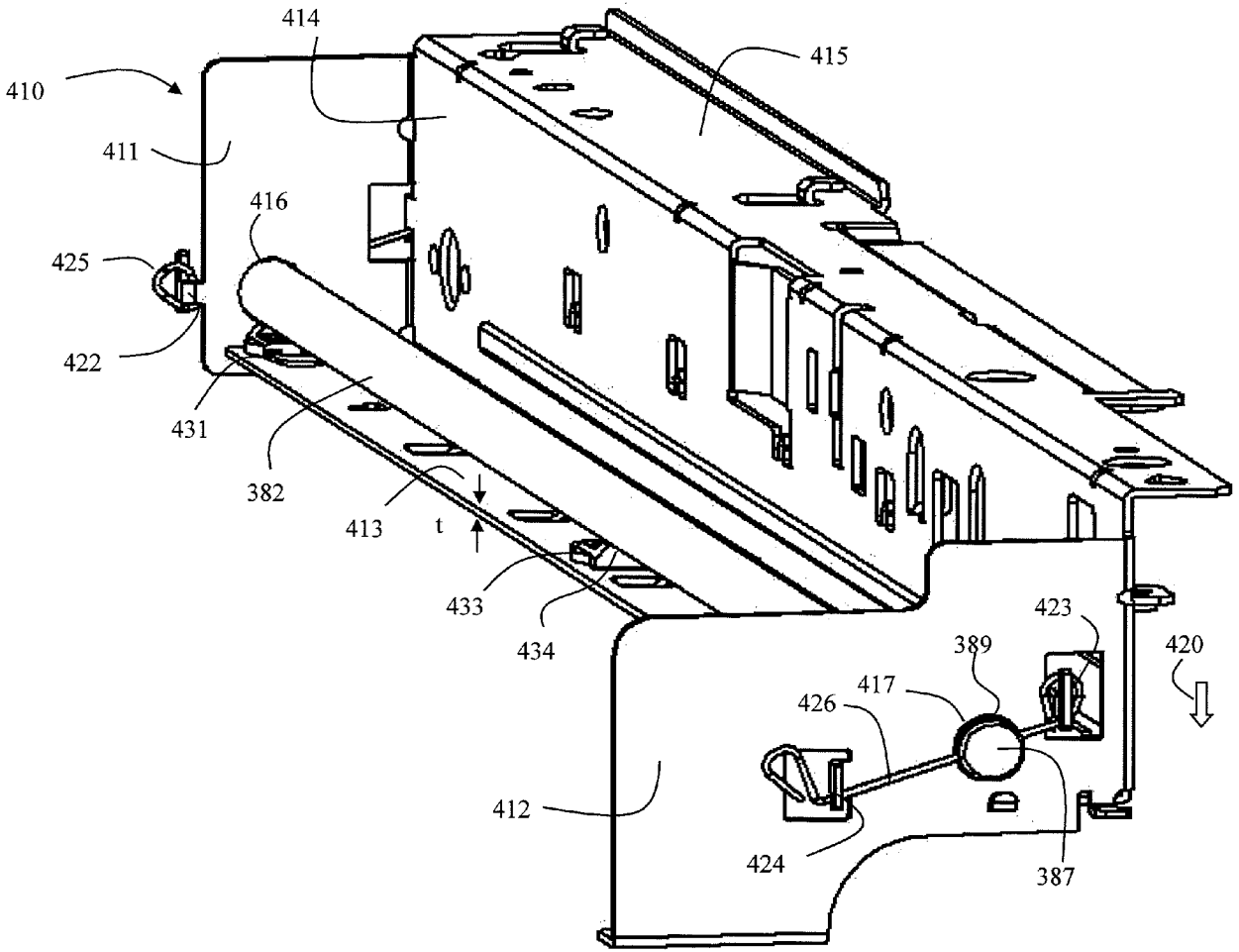
FIG. 7 is a rotated and enlarged perspective of the assembly of FIG. 6.

With reference for FIG. 6 as well as to the rotated and enlarged perspective of FIG. 7, first end 386 of carriage guide 382 extends through a first opening 416 in first wall 411 of frame 410, and second end 387 of carriage guide 382 extends through a second opening 417 in second wall 412 of frame 410. First end 386 of carriage guide 382 includes a first groove 388 and second end 387 of carriage guide 382 includes a second groove 389. First wall 411 includes a first ear 421 and a second ear 422. First spring wire 425 extends from first ear 421 to second ear 422 and bends around first groove 388, thereby applying a first biasing force in bias direction 420 to first groove 388 of carriage guide 382. Second wall 412 includes a third ear 423 and a fourth ear 424. Second spring wire 426 extends from third ear 423 to fourth ear 424 and bends around second groove 389, thereby applying a second biasing force in bias direction 420 to second groove 389 of carriage guide 382. The first biasing force and the second biasing force urge carriage guide 382 into contact with the support surfaces 434 (see also FIGS. 10 and 11) respectively of first carriage guide support 431, second carriage guide support 432 and third carriage guide support 433. Third wall 413 has a thickness t that is typically around 1 mm.

Figure 8:
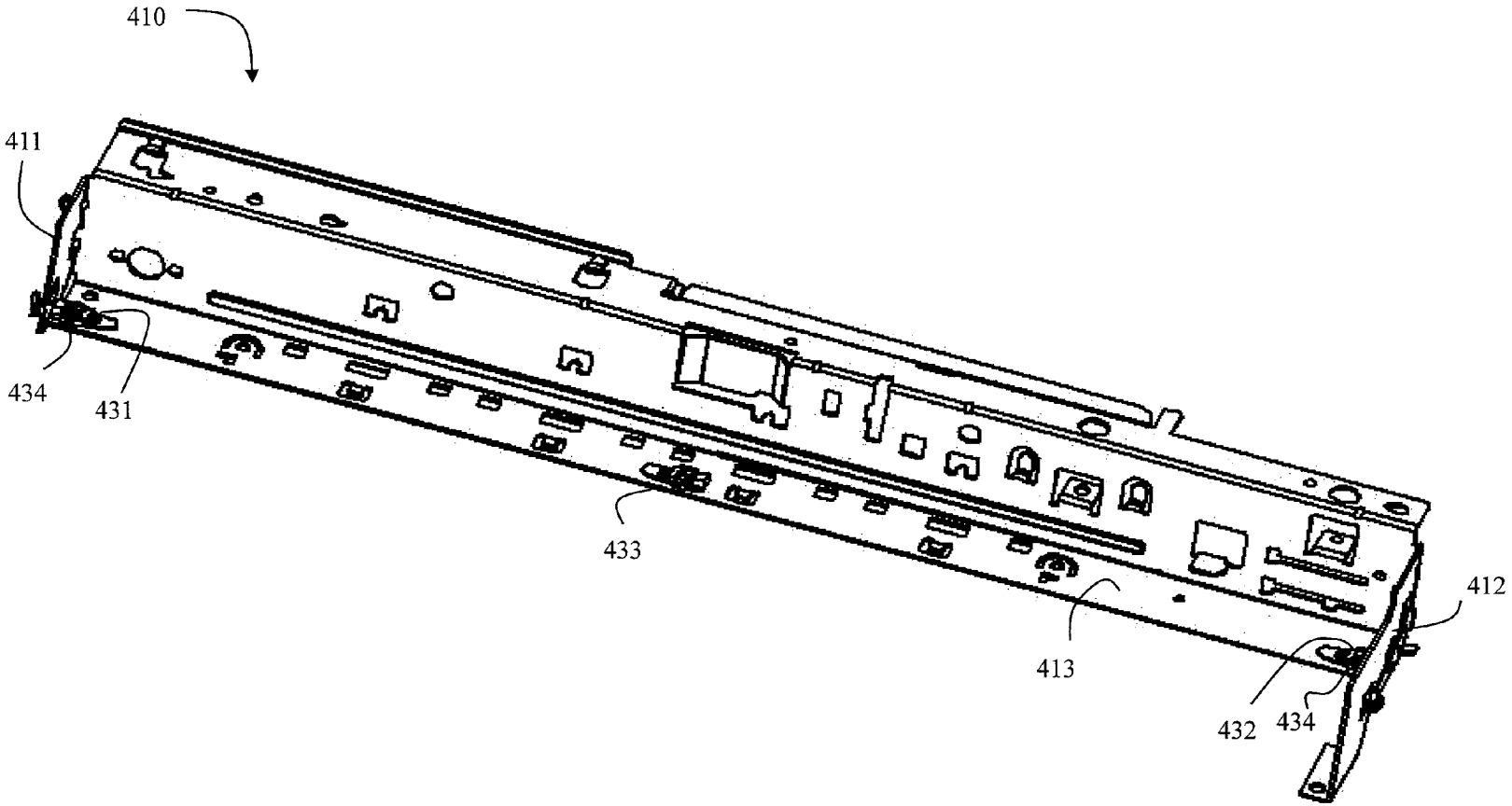
FIG. 8 a perspective of the assembly of FIG. 6, but with the carriage guide hidden.

FIG. 8 is a rotated perspective relative to FIG. 6 and the carriage guide 382 is hidden so that the first carriage guide support 431, the second carriage guide support 432 and the third carriage guide support 433 can all be seen. It can be seen that first carriage guide support 431 and second carriage guide support 432 are oriented in opposite directions. This permits first carriage guide support 431 and second carriage guide support 432 to be identical parts, and also to position the support surfaces 434 closest to first wall 411 and second wall 412 respectively.

Figure 9:
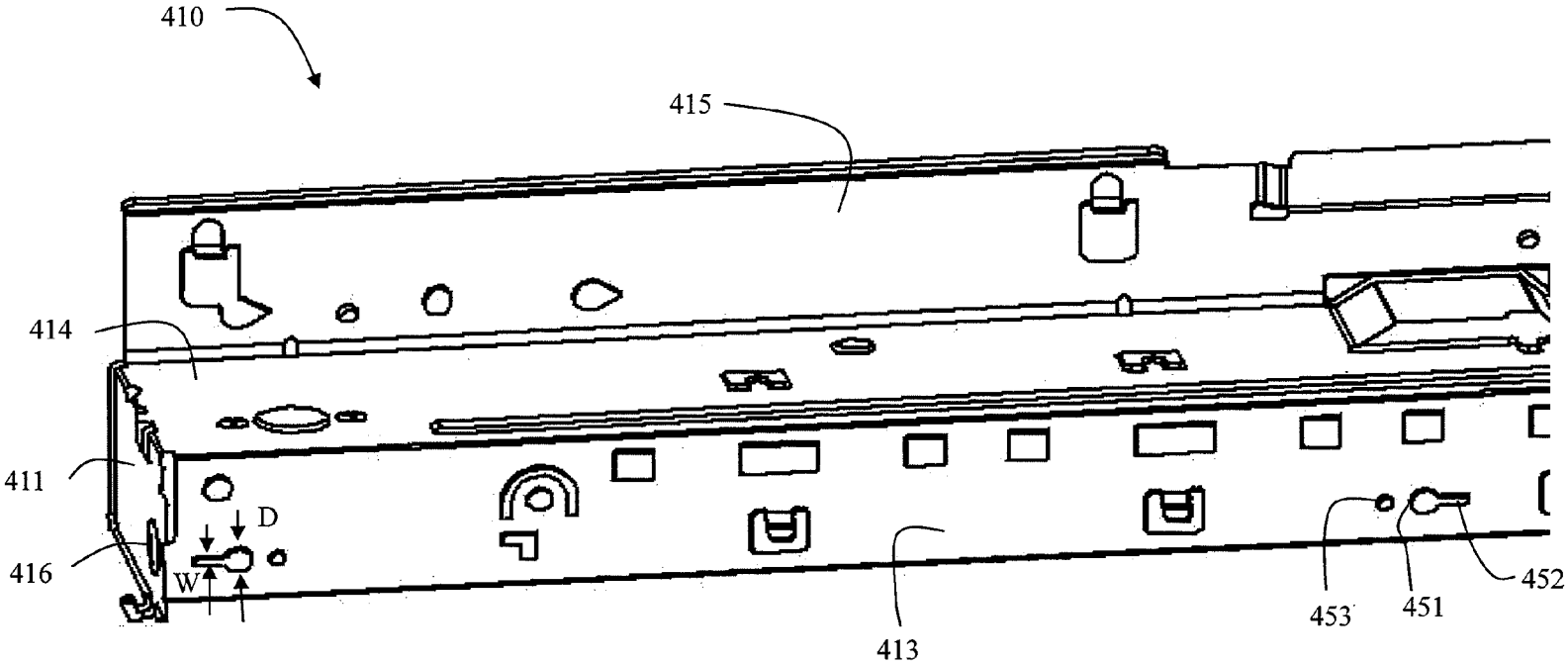
FIG. 9 is a perspective of a portion of a frame part of the assembly of FIG. 6.

FIG. 9 is a top perspective of a portion of frame 410 with carriage guide supports 431, 432, 433 removed in order to show more clearly how the carriage guide supports are affixed to third wall 413 of frame 410. Each carriage guide support is affixed and located relative to third wall 413 using a slot and hole configuration in third wall 413. In particular, corresponding to each of the carriage guide supports, third wall 413 includes a first hole 451 having a diameter D and a slot 452 extending from the first hole 451. Slot 452 has a width W that is less than the diameter D of the first hole 451. A second hole 453 is located nearer to first hole 451 than it is to slot 452.

Figure 10:
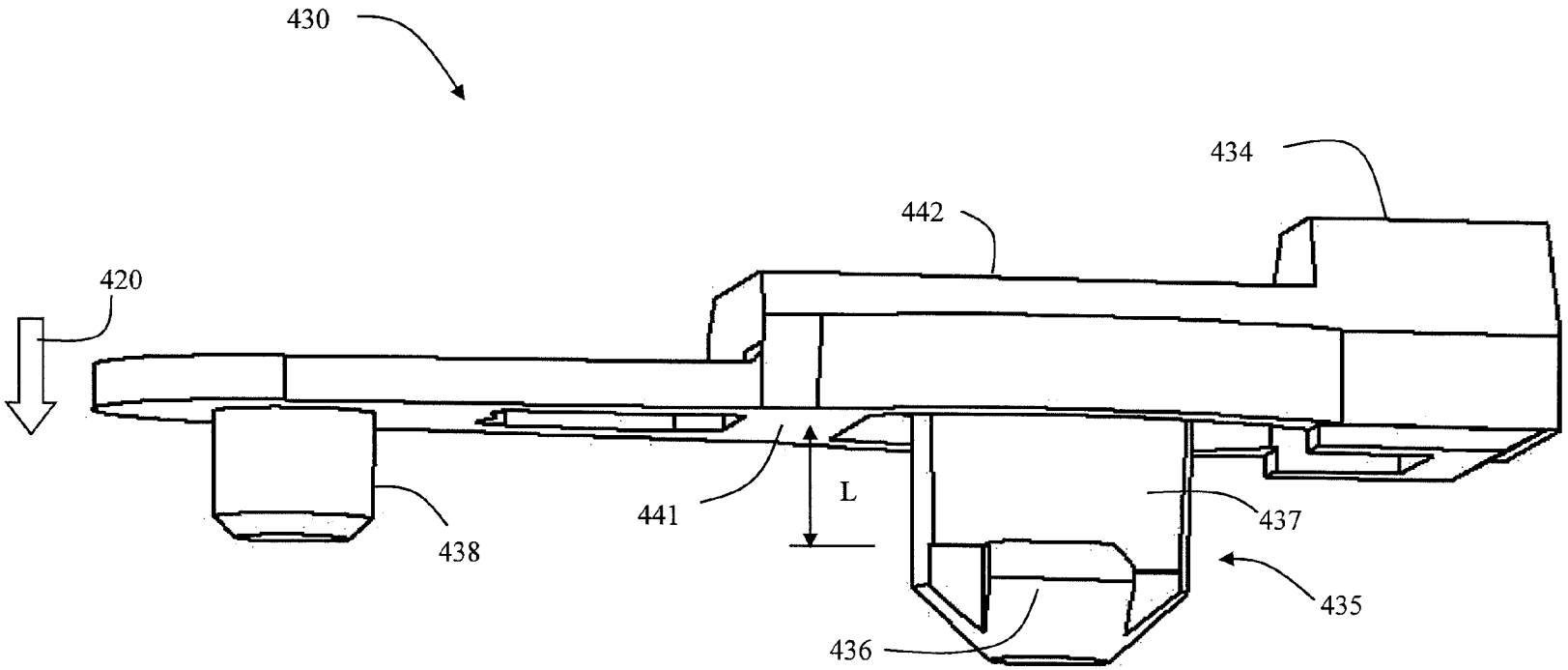
FIG. 10 is a bottom side perspective of an embodiment of a carriage guide support.
Figure 11:
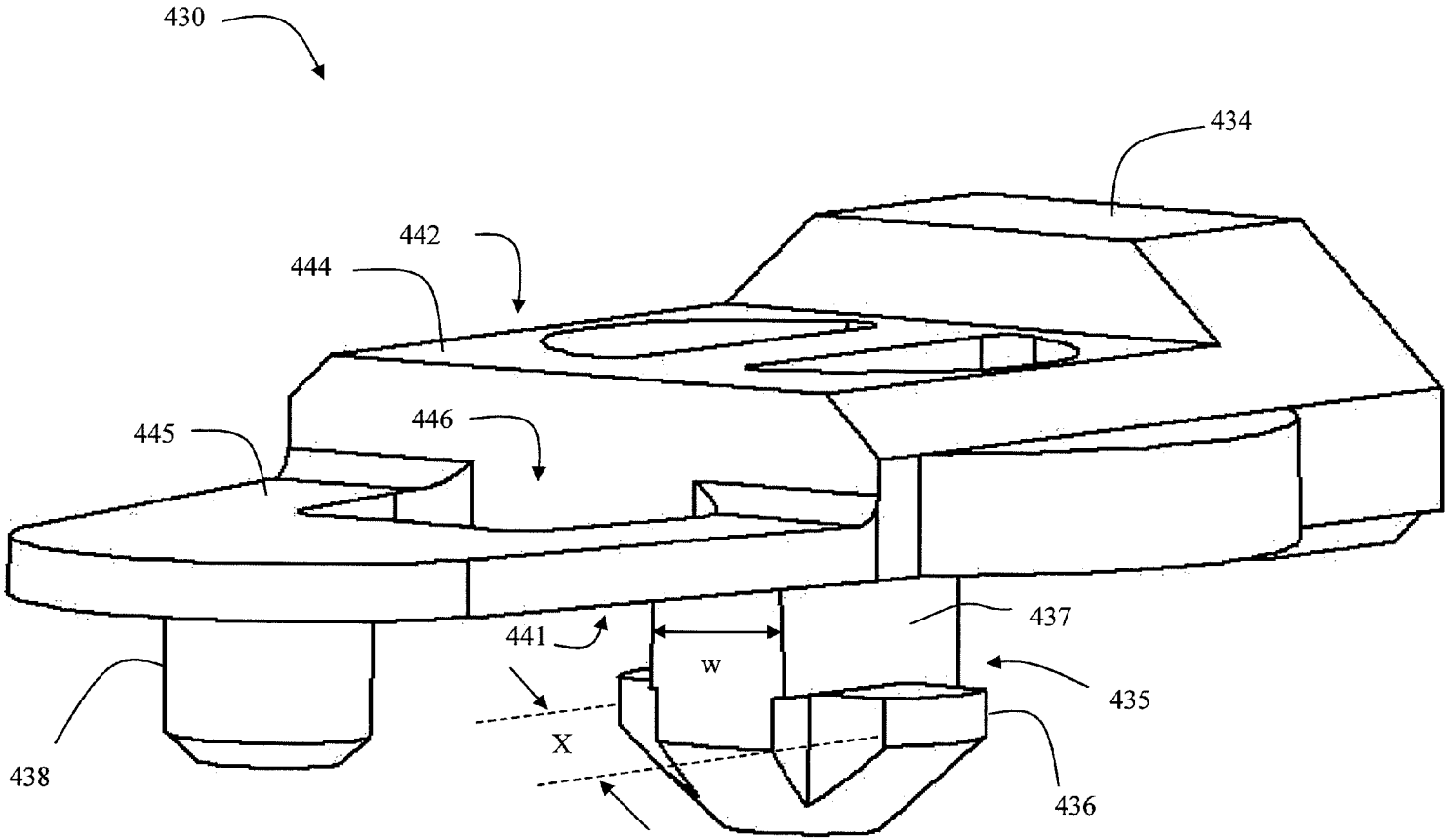
FIG. 11 is a top-side perspective of the carriage guide support of FIG. 10.

A carriage guide support 430 is shown in FIG. 10 from a bottom close-up perspective and in FIG. 11 from a top close-up perspective. Although the carriage guide supports 431, 432 and 433 can be different from one another, in some embodiments they are identical or very similar, so they are shown generically as carriage guide support 430. Carriage guide support 430 includes a notched pin 435 and a projection 438. Notched pin 435 and projection 438 extend along the bias direction 420 from a first side 441 of carriage guide support 430. Support surface 434 of carriage guide support 430 is located relative to a second side 442 (opposite first side 441 of carriage guide support 430) in a direction that is opposite bias direction 420. Notched pin 435 includes a head 436 having an extent X that is less than the diameter D of the first hole 451 (FIG. 9) and that is greater than the width w of slot 452 (FIG. 9). Notched pin 435 also includes a shaft 437 having a length L from first side 441 to head 436. Length L is greater than but approximately equal to the thickness t of the third wall 413 of frame 410 (see FIGS. 7 and 12). Shaft 437 has a width w that is less than the width W of slot 442 (FIG. 9). Carriage guide support 430 includes a first portion 444 having a first thickness and a second portion 445 having a second thickness less than the first thickness, so that second portion 445 is more bendable than first portion 444. Projection 438 extends from second portion 445. In the embodiment shown in FIG. 11, second portion 445 also includes a hollowed region 446, thereby making second portion 445 even more bendable.

Figure 12:
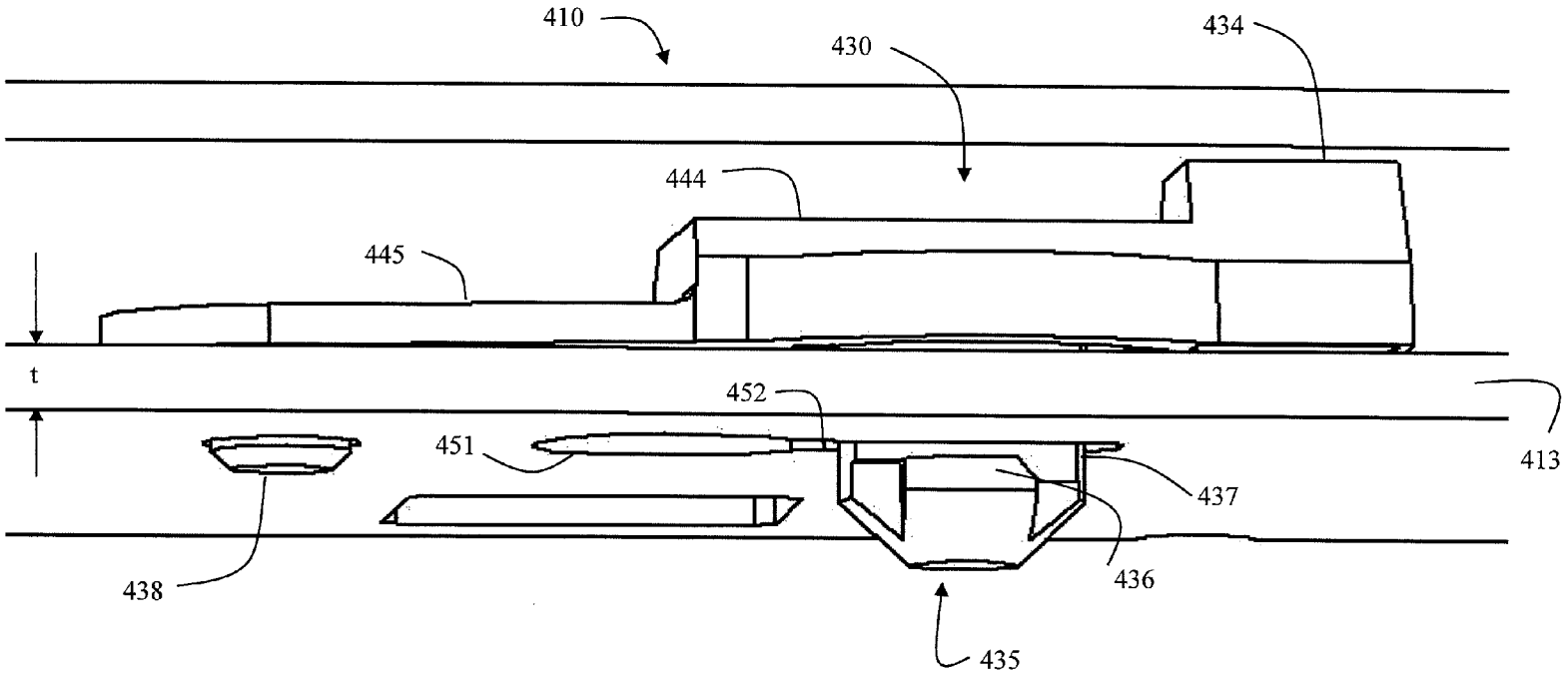
FIG. 12 is a bottom side perspective of the carriage guide support of FIG. 10 mounted on the frame part of FIG. 9.

FIG. 12 is a close-up bottom perspective of a carriage guide support 430 affixed to third wall 413 of frame 410. With reference also to FIGS. 9-11, attachment of carriage guide support 430 to third wall 413 can be done as follows: head 436 (having an extent X that is less than diameter D of first hole 451) of notched pin 435 is inserted into first hole 451 of third wall 413. Carriage guide support 430 is pressed down against third wall 413 and moved along slot 452. Because the width w of shaft 437 is less than the width W of slot 452, notched pin 435 can be moved along slot 452, and head 436 of notched pin 435 (having an extent x that is greater than the width W of slot 452) secures the carriage guide support 430 at the bottom of third wall 413. Because second portion 445 of carriage guide support 430 is configured to be readily bendable, projection 438 can ride along the top surface of third wall 413 as carriage guide support 430 is moved along slot 452. When projection 438 reaches second hole 453, projection 438 enters second hole 453 and locks carriage guide support 430 into a predetermined position along the third wall 413 of frame 410. This procedure is done for each of the three carriage guide supports 431, 432 and 433. Carriage guide supports 431, 432 and 433 can be made at low cost by injection molding. Thus a simple, low-cost way of reducing vibration of the carriage guide 382 is provided.

Figure 13:
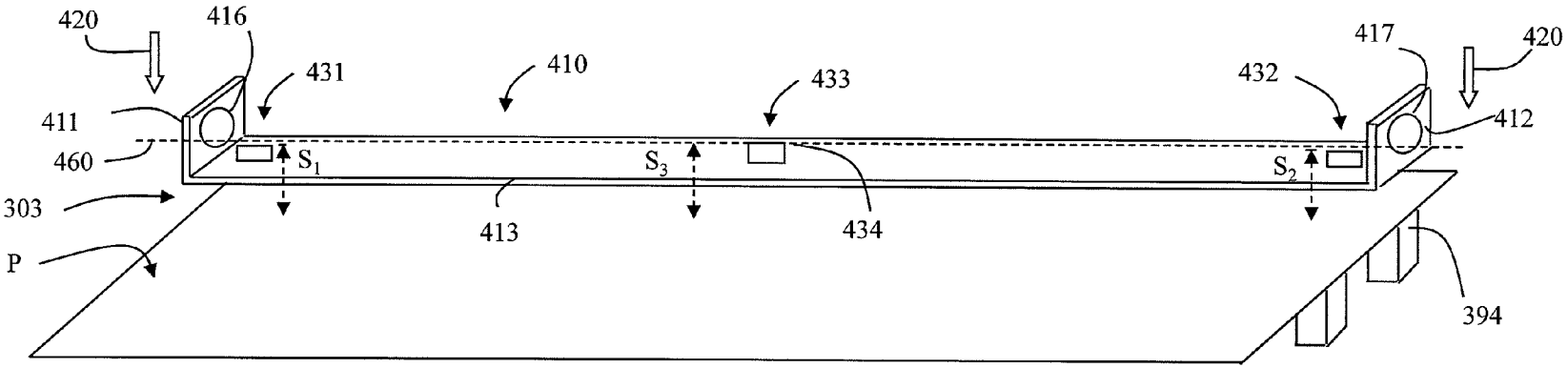
FIG. 13 is a schematic of an assembly similar to FIG. 8 in relation to the plane defined by the print region.

FIG. 13 is a schematic of a frame 410 together with first carriage guide support 431, second carriage guide support 432 and third carriage guide support 433. Also shown is a plane P defined by support ribs 394 in print region 303. Carriage guide 382 is not shown in order to show other features more clearly, but it extends from first opening 416 to second opening 417. In the embodiment shown in FIG. 13, support surface 434 of first carriage guide support 431 is located at a distance $S_1$ from plane P, support surface 434 of second carriage guide support 432 is located at a distance $S_2$ from plane P, and support surface 434 of third carriage guide support 433 is located at a distance $S_3$ from plane P. Dashed line 460 indicates the position of the support surface 434 of the third carriage guide support 433. Comparing the support surfaces 434 of the three carriage guide supports 431, 432, 433 to the position of the dashed line 460, it can be seen that $S_1$ is substantially equal to $S_2$, and $S_3$ is greater than $S_1$. In other words, at least before the first biasing force is applied in bias direction 420 near first wall 411 and the second biasing force is applied in bias direction 420 near second wall 412, the support surface 434 of the carriage guide support 433 is farther from plane P than are the support surfaces 434 of the carriage guide supports 431 and 432 located near the first wall 411 and second wall 412 respectively. The bias force causes bending of the carriage guide 382 (not shown) or deflection downward of third wall 413 near carriage guide support 433 until carriage guide 382 is clamped against the support surfaces 434 of all three carriage guide supports 431, 432 and 433. Typically a difference between $S_3$ and $S_1$ is between 0.05 mm and 0.15 mm.

Clamping of carriage guide 382 against third carriage guide support 433 substantially eliminates the lowest frequency mode of the carriage guide by forcing a node of vibration near the midpoint of the carriage guide. In addition, the plastic carriage guide supports 431, 432 and 433 can have a larger damping constant of mechanical vibration than the damping constant of the carriage guide 382, which is typically made of metal. The larger damping constant of the plastic carriage guide supports 431, 432 and 433, can convert mechanical vibration energy into thermal energy and further reduce the amplitude of vibrations. Thus, the three point support of the carriage guide 382 described herein is very effective in reducing vibrations and improving print quality.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
205 Bushing
250 Printhead
251 Printhead die
253 Nozzle array
254 Nozzle array direction
255 Mounting support member
256 Encapsulant
257 Flex circuit
258 Connector board
262 Multi-chamber ink supply
264 Single-chamber ink supply
270 Ink drops
300 Printer chassis
301 Paper load entry direction
302 Base
303 Print region
304 Media advance direction
305 Carriage scan direction
306 Right side of printer chassis
307 Left side of printer chassis
309 Rear of printer chassis
311 Feed roller gear
312 Feed roller
313 Forward rotation direction (of feed roller)
314 Drive gear
316 Idle gear
320 Media input support
323 Idler roller
324 Discharge roller
325 Star wheel(s)
330 Maintenance station
340 Media retention plate
350 Pick roller
351 Rotation direction
352 Pick arm assembly
370 Stack of media
371 First piece of medium
380 Carriage motor
381 Belt
382 Carriage guide
383 Linear encoder
384 Anti-rotation guide
385 Vibration direction
386 First end
387 Second end
388 First groove
389 Second groove
390 Platen
392 Absorbent material
394 Support ribs
400 Carriage guide assembly
410 Frame
411 First wall
412 Second wall
413 Third wall
414 Back wall
415 Top wall

416 First opening
417 Second opening
420 Bias direction
421 First ear
422 Second ear
423 Third ear
424 Fourth ear
425 First spring wire
426 Second spring wire
430 Carriage guide support
431 First carriage guide support
432 Second carriage guide support
433 Third carriage guide support
434 Support surface
435 Notched pin
436 Head
437 Shaft
438 Projection
441 First side
442 Second side
444 First portion
445 Second portion
446 Hollowed region
451 First hole
452 Slot
453 Second hole
460 Line
D Diameter
L Length
P Plane
$S_1$, $S_2$, $S_3$ Distance
t Thickness
w Width
X Extent

The invention claimed is:

1. A carriage printer comprising:
a printhead;
a print region;
a carriage guide disposed along a carriage scan direction, the carriage guide including a first end and a second end opposite the first end;
a carriage for transporting the printhead along the carriage scan direction across the print region, the carriage including a bearing surface that is configured to contact the carriage guide as the carriage transports the printhead;
a frame including:
a first wall disposed proximate the first end of the carriage guide;
a second wall disposed proximate the second end of the carriage guide; and
a third wall disposed along the carriage scan direction, the third wall including a first hole having a diameter; and a slot having a width, the slot extending from the first hole, the width of the slot being less than the diameter of the first hole;
a plurality of carriage guide supports each including a support surface, the plurality of carriage guide supports including:
a first carriage guide support disposed proximate the first end;
a second carriage guide support disposed proximate the second end; and
a third carriage guide support disposed between the first carriage guide support and the second carriage guide support, wherein one of the first carriage guide support, the second carriage guide support and the third carriage guide support is affixed to the slot in the third wall of the frame,
wherein a first biasing force in a bias direction proximate the first end and a second biasing force in the bias direction proximate the second end urge the carriage guide into contact with the first support surface, the second support surface and the third support surface.

2. The carriage printer of claim 1, wherein the third support surface is disposed approximately midway between the first support surface and the second support surface.

3. The carriage printer of claim 1, the print region defining a plane, the support surface of the first carriage guide support being located at a first distance from the plane, the support surface of the second carriage guide support being located at a second distance from the plane, and the support surface of the third carriage guide support being located at a third distance from the plane, wherein the first distance is substantially equal to the second distance, and wherein the third distance is greater than the first distance.

4. The carriage printer of claim 3, wherein a difference between the third distance and the first distance is between 0.05 mm and 0.15 mm.

5. The carriage printer of claim 1, the third wall further including a thickness, wherein the carriage guide support affixed to the slot comprises a notched pin including:
a head having an extent that is less than the diameter of the first hole and greater than the width of the slot; and
a shaft having a width that is less than the width of the slot, and a length that is greater than but approximately equal to the thickness of the third wall of the frame.

6. The carriage printer of claim 5, the third wall further including a second hole disposed proximate the first hole, and the carriage guide support further including a projection disposed proximate the notched pin, wherein the projection is configured to extend through the second hole in order to lock the carriage guide support into a predetermined position along the third wall of the frame.

7. The carriage printer of claim 6, the carriage guide support further including a first portion having a first thickness, and a second portion having a second thickness less than the first thickness, wherein the notched pin extends from the first portion and wherein the projection extends from the second portion of the carriage guide support.

8. The carriage printer of claim 5, each carriage guide support including a first side and a second side opposite the first side, wherein the notched pin extends along the bias direction from the first side, and wherein the support surface is located relative to the second side in a direction that is opposite the bias direction.

9. The carriage printer of claim 1, wherein the frame is made of sheet metal.

10. The carriage printer of claim 1, wherein the first carriage guide support, the second carriage guide support and the third carriage guide support are made of plastic.

11. The carriage printer of claim 1, the first wall of the frame including a first opening, and the second wall of the frame including a second opening, wherein the first end of the carriage guide extends through the first opening, and wherein the second end of the carriage guide extends through the second opening.

12. The carriage printer of claim 11, the first end of the carriage guide including a first groove, and the second end of the carriage guide including a second groove, wherein the first biasing force is applied to the first groove, and the second biasing force is applied to the second groove.

13. The carriage printer of claim 12, the first wall of the frame including a first ear and a second ear, the carriage printer further including a first spring wire extending from the first ear to the second ear and contacting the carriage guide at the first groove in order to provide the first biasing force.

14. The carriage printer of claim 13, the second wall of the frame including a third ear and a fourth ear, the carriage printer further including a second spring wire extending from the third ear to the fourth ear and contacting the carriage guide at the second groove in order to provide the second biasing force.

15. The carriage printer of claim 1, wherein the carriage guide includes a round rod.

16. The carriage printer of claim 1, the carriage guide further including a first damping coefficient, and at least one of the carriage guide supports further including a second damping coefficient that is greater than the first damping coefficient.

17. The carriage printer of claim 1, wherein the carriage guide is clamped against the first carriage guide support, the second carriage guide support and the third carriage guide support and the third wall is deflected downward proximate the third carriage guide support.

* * * * *